United States Patent [19]

Walworth

[11] 4,340,666

[45] Jul. 20, 1982

[54] METHOD FOR MAKING PHOTOSENSITIVE SILVER HALIDE EMULSION LAYERS

[75] Inventor: Vivian K. Walworth, Concord, Mass.

[73] Assignee: Polaroid Corporation, Cambridge, Mass.

[21] Appl. No.: 234,936

[22] Filed: Feb. 17, 1981

[51] Int. Cl.[3] ..... G03C 1/02

[52] U.S. Cl. ..... 430/569; 430/13; 430/570; 430/599; 430/627; 430/631; 430/935

[58] Field of Search ..... 430/569, 627, 631, 935, 430/570, 599, 13

[56] References Cited

U.S. PATENT DOCUMENTS

| | | | |
|---|---|---|---|
| 3,883,355 | 5/1975 | Walworth | 430/569 |
| 3,941,600 | 3/1976 | Walworth | 430/511 |
| 4,153,462 | 5/1979 | Gerber et al. | 430/569 |

*Primary Examiner*—J. Travis Brown

*Attorney, Agent, or Firm*—Philip G. Kiely

[57] ABSTRACT

Photosensitive silver halide emulsion layers are formed by mixing a solution of a water-soluble complex of silver ion with a polymeric thickening agent, applying the thus formed mixture to a permeable substrate and crystallizing photosensitive silver halide grains therein by decomplexation of said silver halide complex within the layer.

42 Claims, 2 Drawing Figures

1000 X 1.0μ
20,000X

METHOD FOR MAKING PHOTOSENSITIVE SILVER HALIDE EMULSION LAYERS

BACKGROUND OF THE INVENTION

It is known in the art that silver ions can form water-soluble complexes with numerous inorganic and organic compounds. Specific silver complexes include the $AgCl_2^-$, $AgCl_4^{-3}$, $AgBr_3^{-2}$, $AgBr_5^{-4}$, $Ag_2Br^+$, $AgI_2^-$, $AgI_4^{-3}$, $AgCl_3Br^{-3}$, $Ag_3I^{-2}$, and $AgClBr_3^{-3}$ complexes. These complexes are referred to as water-soluble complexes of silver halide complexed with excess halide. Other complexing agents for silver halide include ammonia and the amines, monovalent anions such as cyanide, thiocyanate and the like, polyvalent anions such as thiosulfate, sulfite and the like, and organics, such as acetic acid, glycine, thiourea and the like. It is believed that the foregoing complexes can participate in the growth of the silver halide crystals during physical ripening of the emulsion and influence the kinetics of development. The complexes, including the aforementioned, are known to the art and are set forth on pages 8 and 9 of Mees, *The Theory of the Photographic Process,* 3rd Ed., MacMillan Co., New York. U.S. Pat. Nos. 3,883,355, issued May 13, 1975; 3,941,600, issued Mar. 2, 1976; and 4,153,462, issued May 8, 1979 employ the above-described water-soluble complexes of silver halide in forming photosensitive silver halide emulsion layers.

U.S. Pat. No. 4,153,462 is directed to a method for forming a silver halide photographic emulsion which comprises forming a solution of a water-soluble complex of silver halide and breaking the complex by dilution to provide for the precipitation of the silver halide crystals. The dilution medium contains an agent for modulating the crystallization of the grains. By the selection of the particular modulating agent the size, habit, composition, sensitivity and other properties of the silver halide grains can be affected.

The silver halide complex is preferably added rapidly to the diluting medium and decomplexation and grain formation is substantially instantaneous.

Subsequent to grain formation, the crystals may be washed, treated as desired, for example, by the addition of sensitizing agents and then dispersed in a suitable binder to provide a photographic silver halide emulsion.

U.S. Pat. No. 3,941,600 is directed to a method for forming a photographic silver halide emulsion layer which comprises imbibing a relatively thin layer of a permeable gel substrate with a solution of a water-soluble silver halide complex and, subsequent to imbibing said substrate, breaking the complex to form water-insoluble silver halide grains within the substrate. Decomplexation is achieved by dilution of the water-soluble complex which results in the depletion of the concentration of the halide ion. Excess complex salts remaining associated with the substrate are easily removed by washing.

U.S. Pat. No. 3,883,355 is directed to a method for forming a photographic silver halide emulsion layer which comprises the steps of mixing an aqueous solution of a water-soluble complex of silver halide with a polymeric binder material, forming a layer of the thus-formed mixture and then breaking the complex of the silver halide complex disposed in said layer to form silver halide crystals therein. Decomplexation is preferably achieved by treating the layer with a material to reduce the halide ion concentration, for example, by contacting the layer with sufficient water to accomplish decomplexation by dilution.

Of the above-mentioned methods for forming silver halide emulsion layers, one of the most desirable is the method set forth in U.S. Pat. No. 3,941,600 wherein the water-soluble silver halide complex is applied to an already formed permeable substrate wherein the silver halide crystals are then formed in said substrate.

This method does not require the bulk precipitation and washing of silver halide in large vessels or other such operations which would be time-consuming or have extensive energy consumption requirements.

However, it has been found that the thickness of the substrate can have an effect on the size of the silver halide grains formed therein. It has also been found that when larger grains are formed they are formed relatively near the surface of the substrate and are subject to being removed by washing or abrasion of the substrate during the handling of the coated substrate.

SUMMARY OF THE INVENTION

It has now been found that relatively uniform silver halide grains can be formed within a permeable substrate by applying to said substrate a mixture of a solution of a water-soluble complex of silver ion and a polymeric thickening agent.

DETAILED DESCRIPTION OF THE INVENTION

Figure 1:
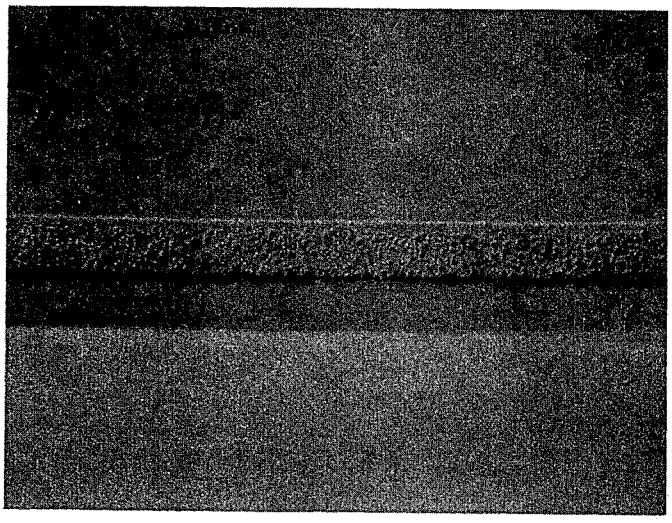
FIG. 1 is an optical micrograph by transmission Nomarski illumination of a cross-section of a support carrying an emulsion prepared by the procedure of the present invention.

It has been unexpectedly found that by employing in the solution of water-soluble silver ion complex a polymeric thickening agent, greater control and better deposition of silver halide grains within the permeable substrate can be achieved. Thus, while an unthickened solution would be expected to imbibe more readily and be more readily retained in the permeable substrate, it has been found that this is not the case. By employing a relatively small amount of polymeric thickener in the solution of water-soluble silver ion complex, advantages are achieved which are unobtainable by prior art methods of forming silver halide grains by decomplexation of a silver ion complex.

In disposing the polymeric thickening agent in a solution of water-soluble complex of silver halide, for example, care should be taken that the concentration of the halide ion is not reduced which would result in premature decomplexation before the complex was introduced into the permeable substrate. For this reason it is preferred to add the polymeric thickening agent in the dry form. Since the solution of complex is a concentrated solution the polymer must be one which would not salt out.

Any natural or synthetic polymeric thickener material may be employed in the present invention with the provision, as stated above, that due care be taken in selecting the thickener and the concentration of thickener to avoid salting out in the complex solution. Preferably, polyacrylamide is employed.

Other suitable polymeric thickener materials include natural and/or synthetic polymeric materials such as gelatin; albumen; casein; carrageenan or resins such as a cellulose derivative as described in U.S. Pat. Nos. 2,322,085 and 2,541,474; vinyl polymers such as those described as useful in the invention disclosed and claimed in U.S. Pat. No. 3,883,355.

The term "permeable substrate" as used herein is intended to refer to a natural or synthetic polymeric material which is conventionally employed in silver halide emulsion preparation which is permeable to the solution of water-soluble silver ion complex such that said complex would be imbibed into said permeable substrate.

Suitable materials for use as the permeable substrate include those specified above.

The permeable substrate as used herein is in the solid state of the substrate as it is customarily found in conventional negatives.

In a specific preparation, the polymers employed for the permeable substrate and the thickening agent may be the same or different. In a preferred embodiment, the polymers are selected on the basis of a difference in protective colloid properties, i.e., the relative effect on the precipitation of silver halide. Preferably, the polymer selected for the polymeric thickener is one, e.g., polyvinyl alcohol or polyacrylamide, which would inhibit or retard silver halide grain growth relative to the polymer of the permeable substrate; whereas the permeable substrate comprises a polymer, for example, gelatin, which promotes silver halide grain growth relative to the polymeric thickening agent.

The substrate employed in the present invention may be carried on a suitable carrier or support or may be self-supporting.

The water-soluble complex of silver ion may comprise any of the above-mentioned water-soluble complexes as well as mixtures thereof, including water-soluble complexes of silver ion complexed with excess halide, ammonia or amines, thiocyanate and halide and thiocyanate.

The thickened solution of water-soluble silver ion complex of the present invention may be applied to the permeable substrate by any conventional techniques known to the art, for example, slot coating, curtain coating, wire wound coating rod, and the like. In a particularly preferred embodiment, the thickened solution is applied to the permeable polymeric substrate as a laminating fluid. For example, the thickened solution may be disposed between a cover sheet and the permeable substrate and the thus-formed sandwich passed through gapped rollers to provide pressure and predetermined spacing between the cover sheet and the gelatin layer. It is found that more effective deposition of silver halide grains subsequent to decomplexation occurs in the permeable polymeric substrate employing this method. The gap may range over a relatively wide range, for example, between about 0 and 0.0100 in. Particularly preferred is 0.0015 in. It has also been found that the time between the application of the thickened solution of water-soluble complex and decomplexation affects the deposition of silver halide in the permeable polymeric layer. The time may range from about 30 seconds to about 30 minutes. The specific time is selected by routine scoping tests based on the polymers selected for the substrate and the thickening agent, the modulating agents employed and other conditions.

The present invention is particularly suitable for use in the preparation of arrayed silver halide grains as disclosed and claimed in copending application of Edwin H. Land, Ser. No. 234,937, filed concurrently herewith.

The permeable substrate may be pretreated prior to the application of the thickened solution of complex. This pretreatment may include modifying porosity, hardness etc., or the inclusion of various materials therein to modulate the grain characteristics formed therein. For example, the permeable substrate may include buffers, nucleating particles, dye developers, couplers, antifoggants, chemical sensitizers, spectral sensitizers, halide salts, cross-linking agents and the like.

Similarly, such modulating agents as described above for incorporation in the permeable layer may also be disposed in the thickened complex to promote subsequent decomplexation and grain formation. Care should be taken, however, to avoid premature decomplexation in the polymeric thickening agent. Further, various combinations of said modulating agents may be employed both in the permeable substrate and in the thickened complex.

Decomplexation may be regulated by heating or cooling the substrate subsequent to the application of the thickened complex.

The following non-limiting examples illustrate the novel method of the present invention.

EXAMPLE A (Preparation of silver bromide complex)

A saturated solution of silver bromide complex was prepared by adding at approximately 20° C. 3.2 g of silver nitrate dissolved in 3.75 g of water to 77 g of a 12.3 N lithium bromide solution. The resulting solution was stirred until clear, then filtered through #4 Whatman paper.

EXAMPLE 1

To the solution prepared in Example A was added 1 g of polyacrylamide (Cyanamer P-250, American Cyanamide Co., Wayne, N.J.) and the solution was stirred until clear and then filtered through #4 Whatman paper. The thus-formed viscous solution was poured into a nip formed by a polyester cover sheet and a layer comprising 200 mg/ft$^2$ of gelatin, 2.3 mg/ft$^2$ of fine grain silver iodide and 1% mucochloric acid carried on a 4 mil cellulose triacetate support. The nip rolls provided a gap between the cover sheet and the gelatin layer of 0.0015 inches. After passing the substrate and the cover sheet through the rollers, they were maintained together for 30 seconds and then the cover sheet was stripped off and the gelatin layer washed with water for 30 seconds. The layer contained silver halide crystals and analysis showed 34 mg/ft$^2$ of silver; 1.10 mole ratio of bromide to silver and 0.02 mole ratio of iodide to silver. The thus-formed emulsion layer was exposed to a step wedge at 16 mcs and processed with a Type 42 receiving sheet and processing composition (Polaroid Corporation, Cambridge, MA). The silver transfer image showed a $D_{max}$ of about 1.79 and a $D_{min}$ of about 0.02 (reflection density).

EXAMPLE 2

Figure 2:
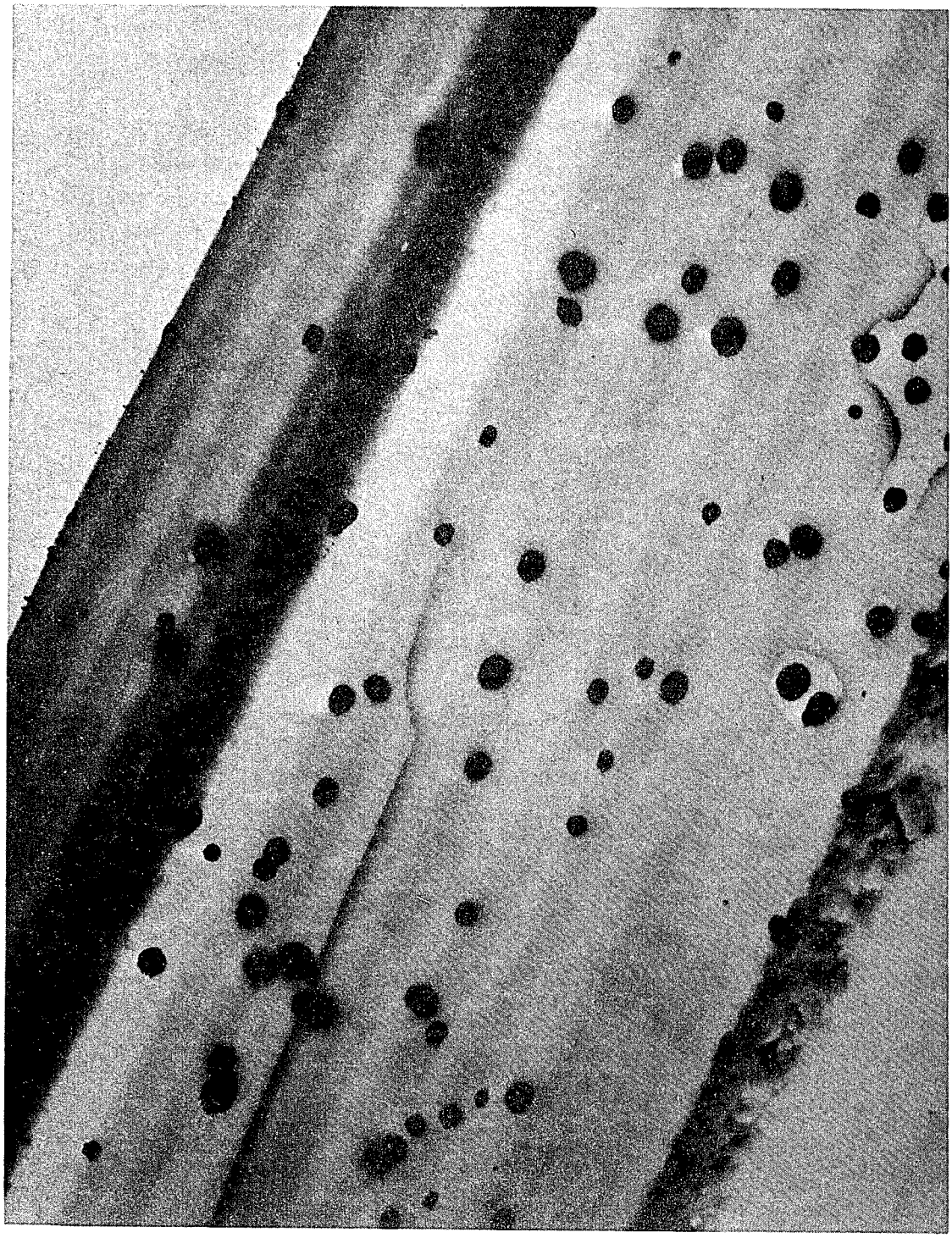
FIG. 2 is an electron micrograph at 20,000X magnification of a cross-section of the same emulsion shown in FIG. 1.

To the complex prepared in Example A was added 0.25 g of carrageenan. The thus-formed solution was then poured into the nip formed by a polyester cover sheet and 200 mg/ft$^2$ of gelatin carried on a 4 mil cellulose triacetate base. Rollers provided a gap of 0.0014 inches between the cover sheet and the gelatin layer. The cover sheet was removed after 30 seconds and the gelatin layer was washed with distilled water at room temperature. Analysis showed a silver coverage of about 26.8 mg/ft$^2$ and a Br/Ag mole ratio of 2.35. FIG. 1 is an optical micrograph (transmission Nomarski, 1000X magnification) showing particles of silver bromide throughout the layer in clusters ranging in size up to about 0.4 microns. FIG. 2 is an electron micrograph at 20,000X magnification showing the distribution of the silver bromide grains throughout the layer.

EXAMPLE 3

To the complex solution prepared in Example A was added about 3% of gelatin based on the weight of the solution. The thus-formed thickened solution of water-soluble silver halide complex was applied with a #30 wire wound coating rod to a gelatin layer (about 100 mg/ft$^2$) carried on a cellulose triacetate support. The gelatin layer was later immersed in water. A slight deposit of silver halide was noted within the gelatin layer and the coverages were appreciably less than those obtained using the cover sheet and gap rollers.

EXAMPLE 4

The thickened complex solution was prepared as in Example 2 except that about 3% of polyvinyl alcohol (ELVANOL 70-05, sold by E. I. duPont de Nemours Inc., Wilmington, Del.) was employed. The silver halide emulsion layer was prepared by the procedure of Example 3 and similar results were obtained as in Example 3.

EXAMPLE 5

The water-soluble silver bromide complex prepared according to the procedure of Example 4 was disposed in the nip formed by a polyester cover sheet and a gelatin layer (200 mg/ft$^2$ of gelatin) carried on a cellulose triacetate film base. The rollers provided a 0.0014 inch gap between the cover sheet and the gelatin layer. After passing through the rollers the cover sheet remained in place for 30 seconds and was then removed. The gelatin layer was washed in a solution of 1% potassium bromide at 22.5° C. Microscopy showed silver halide grains in the form of spheres throughout the layer. A repeat of this procedure using water at 22.5° C. instead of the potassium bromide solution to provide for decomplexation of the complex showed larger grains to be formed than with the potassium bromide solution.

Silver halide grains prepared by the present invention may be chemically sensitized by conventional chemical sensitizers known to the art, e.g., gold or noble metal sensitization, sulfur sensitization, such as by a labile sulfur compound, and reduction sensitization, i.e., treatment of the silver halide with a strong reducing agent. With regard to the use of chemical sensitizing agents, mention may be made of U.S. Pat. Nos. 1,574,944; 1,623,499; and 2,410,689.

The silver halide grains can also be treated with salts of the noble metals, such as ruthenium, rhodium, palladium, iridium and platinum. Representative compounds are ammonium chloropalladate, potassium chloroplatinate, and sodium chloropalladate, as described in U.S. Pat. Nos. 2,448,060; 2,566,245; and 2,566,263.

The silver halide grains can also be chemically sensitized with gold salts as described in U.S. Pat. Nos. 2,399,083 and 2,642,361. Suitable compounds are potassium chloroaurate, potassium aurothiocyanate, potassium chloroaurate, auric trichloride and 2-aurosulfobenzothiazole methochloride.

The silver halide grains can also be reduction sensitized with reducing agents, such as stannous salts as described in U.S. Pat. No. 2,487,850, polyamines, such as diethylene triamine as described in U.S. Pat. No. 2,518,698, polyamines, such as spermine as described in U.S. Pat. No. 2,521,925 or bis($\beta$-aminoethyl) sulfide and its water-soluble salts as described in U.S. Pat. No. 2,521,926.

Sensitizers of the solid semiconductor type, such as lead oxide, may also be employed. Such sensitizers are disclosed and claimed in U.S. Pat. Nos. 3,852,066 and 3,852,067.

The chemical sensitizers employed may be predisposed in the substrate prior to the crystal formation; in the soluble complex solution, in the diluting medium or in a subsequent solution for application to the grains.

Spectral sensitization of the silver halide crystals may be accomplished by contact of the crystal composition with an effective concentration of the selected spectral sensitizing dyes dissolved in appropriate dispersing solvent such as methanol, ethanol, acetone, water and the like; all according to the traditional procedures of the art, as described in Hamer, F. M., The Cyanine Dyes and Related Compounds, or by predisposing the dye in the substrate prior to formation of silver halide crystals. Alternatively, the dye may be employed in the water-soluble complex solution or in the diluting medium.

Additional optional additives, such as coating aids, hardeners, viscosity-increasing agents, stabilizers, preservatives, and the like, also may be incorporated in the solution prior to and/or subsequent to the formation of the grains.

What is claimed is:

1. A method for forming a photosensitive silver halide emulsion layer which comprises the steps of applying a mixture of a solution of a water-soluble complex of silver ion and a polymeric thickening agent to a permeable substrate, imbibing said complex into said permeable substrate and crystallizing photosensitive silver halide grains by decomplexation of said complex within said permeable substrate wherein said polymeric thickening agent comprises a polymer which inhibits silver halide grain growth relative to said permeable substrate and said permeable substrate comprises a polymer which promotes silver halide grain growth relative to said thickening agent.

2. The method of claim 1 wherein said complex is a water-soluble complex of silver halide complexed with excess halide.

3. The method of claim 1 wherein said complex is a water-soluble complex of silver halide complexed with ammonia or amines.

4. The method of claim 1 wherein said complex is a water-soluble complex of silver ion complexed with thiocyanate.

5. The method of claim 1 wherein said complex is a water-soluble complex of silver ion complexed with excess halide and thiocyanate.

6. The method of claim 1 wherein said permeable substrate is gelatin.

7. The method of claim 1 wherein said polymeric thickening agent is a natural polymer.

8. The method of claim 8 wherein said natural polymer is carrageenan.

9. The method of claim 1 wherein said polymeric thickening agent is a synthetic polymer.

10. The method of claim 9 wherein said synthetic polymer is polyacrylamide.

11. The method of claim 9 wherein said synthetic polymer is polyvinyl alcohol.

12. The method of claim 1 wherein said permeable substrate includes an agent for modulating the crystallization of said silver halide grains.

13. The method of claim 12 wherein said permeable substrate includes particulate material adapted to provide nucleating material for the formation of said silver halide grains.

14. The method of claim 12 wherein said permeable substrate includes a water-soluble halide salt disposed therein.

15. The method of claim 1 wherein said permeable substrate includes chemical sensitizing agents disposed therein.

16. The method of claim 1 wherein said permeable substrate includes spectral sensitizing agents disposed therein.

17. The method of claim 14 wherein said water-soluble halide salt comprises the same halide as the halide of the water-soluble complex.

18. The method of claim 2 wherein said complex is a saturated silver bromide complex.

19. The method of claim 1 wherein said decomplexation is carried out by washing said permeable substrate with water.

20. The method for forming a photosensitive silver halide emulsion layer which comprises the steps, in sequence, of disposing a mixture of a solution comprising a water-soluble complex of silver ion and a polymeric thickening agent between a permeable substrate and a cover sheet, laminating the thus-formed sandwich and crystallizing photosensitive silver halide grains by decomplexation of said complex within said permeable layer wherein said polymeric thickening agent comprises a polymer which inhibits silver halide grain growth relative to said permeable substrate and said permeable substrate comprises a polymer which promotes silver halide grain growth relative to said thickening agent.

21. The method of claim 20 which comprises the steps of disposing said water-soluble complex and a polymeric thickening agent in a nip formed by a polymeric cover sheet and said permeable substrate and applying pressure to said cover sheet and said permeable substrate.

22. The method of claim 21 wherein said pressure is applied by passing said cover sheet and said permeable substrate between pressure applying rollers.

23. The method of claim 22 wherein said rollers provide a gap between said cover sheet and said permeable substrate of about 0 to 0.010 in.

24. The method of claim 23 wherein said gap is about 0.0015 in.

25. The method of claim 1 wherein said complex is a water-soluble complex of silver halide complexed with excess halide.

26. The method of claim 1 wherein said complex is a water-soluble complex of silver halide complexed with ammonia or amines.

27. The method of claim 20 wherein said complex is a water-soluble complex of silver ion complexed with thiocyanate.

28. The method of claim 20 wherein said complex is a water-soluble complex of silver ion complexed with excess halide and thiocyanate.

29. The method of claim 20 wherein said permeable substrate is gelatin.

30. The method of claim 20 wherein said polymeric thickening agent is a natural polymer.

31. The method of claim 30 wherein said natural polymer is gelatin.

32. The method of claim 20 wherein said polymeric thickening agent is a synthetic polymer.

33. The method of claim 32 wherein said synthetic polymer is polyacrylamide.

34. The method of claim 32 wherein said synthetic polymer is polyvinyl alcohol.

35. The method of claim 20 wherein said permeable substrate includes an agent for modulating the crystallization of said silver halide grains.

36. The method of claim 20 wherein said permeable substrate includes particulate material adapted to provide nucleating material for the formation of said silver halide grains.

37. The method of claim 36 wherein said permeable substrate includes a water-soluble halide salt disposed therein.

38. The method as defined in claim 20 wherein said permeable substrate includes chemical sensitizing agents disposed therein.

39. The method of claim 20 wherein said permeable substrate includes spectral sensitizing agents disposed therein.

40. The method of claim 37 wherein said water-soluble halide salt comprises the same halide as the halide of the water-soluble complex.

41. The method of claim 25 wherein said complex is a saturated silver bromide complex.

42. The method of claim 20 wherein said decomplexation is carried out by washing said permeable substrate with water.

* * * * *